US009788130B2

(12) United States Patent
Müller

(10) Patent No.: US 9,788,130 B2
(45) Date of Patent: Oct. 10, 2017

(54) REMOVABLE BATTERY HOLDER IN A HEARING ASSISTANCE DEVICE

(71) Applicant: Advanced Bionics AG, Staefa (CH)

(72) Inventor: Andreas Müller, Schindellegi (CH)

(73) Assignee: Advanced Bionics AG, Staefa (CH)

( * ) Notice: Subject to any disclaimer, the term of this patent is extended or adjusted under 35 U.S.C. 154(b) by 40 days.

(21) Appl. No.: 14/759,717

(22) PCT Filed: Mar. 4, 2013

(86) PCT No.: PCT/US2013/028946
§ 371 (c)(1),
(2) Date: Jul. 8, 2015

(87) PCT Pub. No.: WO2014/113044
PCT Pub. Date: Jul. 24, 2014

(65) Prior Publication Data
US 2015/0350797 A1 Dec. 3, 2015

Related U.S. Application Data

(60) Provisional application No. 61/752,915, filed on Jan. 15, 2013.

(51) Int. Cl.
*H04R 25/00* (2006.01)
*H04R 1/10* (2006.01)

(52) U.S. Cl.
CPC ..... *H04R 25/602* (2013.01); *H04R 1/1041* (2013.01); *H04R 1/1025* (2013.01); *H04R 2225/021* (2013.01); *H04R 2225/31* (2013.01)

(58) Field of Classification Search
CPC ..... H04R 1/1025; H04R 1/1041; H04R 2225/021; H04R 2225/31; H04R 2225/61; H04R 25/602
See application file for complete search history.

(56) References Cited

U.S. PATENT DOCUMENTS 3,138,491 A * 6/1964 Komatsu ..... H01H 29/00 200/61.58 R
4,941,180 A * 7/1990 Buettner ..... H04R 25/602 381/323

(Continued)

FOREIGN PATENT DOCUMENTS

DE 3723809 A1 1/1989
DE 10 2010 013749 A1 4/2011

(Continued)

OTHER PUBLICATIONS

PCT International Search and Written Opinion dated Jan. 2, 2014 for PCT App. Ser. No. PCT/US2013/028946.

(Continued)

*Primary Examiner* — Joshua Kaufman
(74) *Attorney, Agent, or Firm* — Henricks, Slavin & Holmes LLP

(57) ABSTRACT

A power supply system used in a hearing assistance device including a housing including a battery storage region, a first removable battery holder including a first latch having a first latch configuration and configured to fit within the battery storage region and to hold at least one battery, and a second removable battery holder including a second latch having a second latch configuration that is different that the first latch configuration and configured to fit within the battery storage region and to hold at least one battery.

13 Claims, 7 Drawing Sheets

(56) References Cited

U.S. PATENT DOCUMENTS 4,947,439 A * 8/1990 Buettner ..... H04R 25/602 381/323
5,062,138 A * 10/1991 Schmid ..... H04R 25/602 381/322
5,347,584 A * 9/1994 Narisawa ..... H04R 25/602 381/323
5,386,476 A * 1/1995 Bisgaard ..... H04R 25/602 381/23.1
5,675,657 A * 10/1997 Giannetti ..... H01M 2/20 381/312
6,041,128 A * 3/2000 Narisawa ..... H04R 25/602 381/322
6,144,749 A * 11/2000 Fideler ..... H04R 25/602 381/312
6,831,988 B2 * 12/2004 Vonlanthen ..... H04R 25/556 381/314
7,916,883 B2 3/2011 Crook
2004/0049243 A1 * 3/2004 Seligman ..... A61N 1/36032 607/57
2004/0062408 A1 * 4/2004 Jorgensen ..... H04R 25/602 381/323
2004/0190743 A1 * 9/2004 Chen ..... H04R 1/105 381/370
2005/0286732 A1 * 12/2005 Linkenkaer-Hansen ..... H04R 25/602 381/322
2007/0036372 A1 * 2/2007 Vonlanthen ..... H04R 25/602 381/312
2007/0081684 A1 * 4/2007 Crook ..... H04R 25/602 381/322
2008/0013765 A1 * 1/2008 Nielsen ..... H04R 25/602 381/322
2008/0251410 A1 10/2008 Gelardi
2009/0110222 A1 * 4/2009 Heerlein ..... H04R 25/602 381/323
2009/0202092 A1 * 8/2009 Ruppert ..... H01M 2/1044 381/323
2010/0054488 A1 3/2010 Young
2010/0202644 A1 * 8/2010 Angst ..... H04R 25/602 381/323
2010/0226519 A1 * 9/2010 Spragge ..... H04R 25/602 381/323
2010/0260366 A1 * 10/2010 Heerlein ..... H04R 25/602 381/323
2010/0290655 A1 * 11/2010 Takeda ..... H04R 25/602 381/323
2011/0211718 A1 * 9/2011 Chua ..... H04R 25/602 381/323
2012/0041517 A1 * 2/2012 Walsh ..... A61N 1/36032 607/57
2012/0093349 A1 * 4/2012 Chua ..... H04R 25/602 381/323
2012/0140968 A1 * 6/2012 Tada ..... H04R 25/405 381/330
2013/0236041 A1 * 9/2013 Flaig ..... H04R 25/65 381/323
2014/0177893 A1 * 6/2014 Lu ..... H04R 25/602 381/323
2015/0289068 A1 * 10/2015 Sundberg ..... H04R 25/608 381/323
2015/0350797 A1 * 12/2015 Muller ..... H04R 25/602 381/323

FOREIGN PATENT DOCUMENTS

EP 1622420 A2 2/2006
EP 2144456 A1 1/2010
JP 63-39864 U 3/1988
WO WO 2004/073351 A1 8/2004
WO WO 2010/068177 A1 6/2010

OTHER PUBLICATIONS

Cochlear Limited "Cochlear Nucleus CP810 Sound Processor User Guide." Oct. 14, 2010.

* cited by examiner

REMOVABLE BATTERY HOLDER IN A HEARING ASSISTANCE DEVICE

CROSS-REFERENCE TO RELATED APPLICATIONS

This application is the U.S. National Stage of PCT App. Ser. No. PCT/US2013/028946, filed Mar. 4, 2013, which claims priority to U.S. Prov. App. Ser. No. 61/752,915, filed Jan. 15, 2013.

BACKGROUND

1. Field

The present disclosure relates generally to hearing assistance devices such as, for example, implantable cochlear stimulation ("ICS") systems and hearing aids.

2. Description of the Related Art

A wide variety of hearing assistance devices are available. Such devices include, but are not limited to, ICS systems and hearing aids.

ICS systems are used to help the profoundly deaf perceive a sensation of sound by directly exciting the intact auditory nerve with controlled impulses of electrical current. Ambient sound pressure waves are picked up by an externally worn microphone and converted to electrical signals. The electrical signals, in turn, are processed by sound processor circuitry, converted to a pulse sequence having varying pulse widths and/or amplitudes, and transmitted to an implanted receiver circuit of the ICS system. The implanted receiver circuit is connected to an implantable electrode array that has been inserted into the cochlea of the inner ear, and electrical stimulation current is applied to varying electrode combinations to create a perception of sound. A representative ICS system is disclosed in U.S. Pat. No. 5,824,022, which is entitled "Cochlear Stimulation System Employing Behind-The-Ear Sound processor With Remote Control" and incorporated herein by reference in its entirety.

As alluded to above, some ICS systems include an implantable device, a sound processor, with the sound processor circuitry, and a microphone that is in communication with the sound processor circuitry. The implantable device communicates with the sound processor and, to that end, some ICS systems include a headpiece that is in communication with both the sound processor and the implantable device. The microphone may be part of the sound processor or the headpiece. In one type of ICS system, the sound processor is worn behind the ear (a "BTE sound processor"), while other types of ICS systems have a body worn sound processor unit (or "body worn sound processor"). The body worn sound processor, which is larger and heavier than a BTE sound processor, is typically worn on the user's belt or carried in the user's pocket. Examples of commercially available ICS sound processors include, but are not limited to, the Advanced Bionics Harmony™ BTE sound processor.

Hearing aids include a microphone, sound processor circuitry, and a speaker (sometimes referred to as a "receiver"). Here too, ambient sound pressure waves are picked up by the microphone and converted into electrical signals. The electrical signals, in turn, are processed by sound processor circuitry. The processed signals drive the speaker, which delivers amplified (or otherwise processed) sound pressure waves to the ear canal. Exemplary types of hearing aids include, but are not limited to, BTE hearing aids, receiver-in the-canal ("RIC") hearing aids, and in-the-canal ("ITC") hearing aids. Examples of commercially available hearing aids include, but are not limited to, the Phonak Ambra™ hearing aid and the Phonak Naida™ hearing aid.

Hearing assistance devices are typically powered by one or more batteries. In some instances, hearing assistance devices include a removable battery pack in which a rechargeable battery is housed. Other hearing devices employ batteries that are removable and replaceable, e.g. zinc-air batteries, by way of a battery compartment door or a battery holder that pivots out of the hearing assistance device housing to a position at which the batteries may be replaced.

The present inventor has determined that conventional hearing assistance devices are susceptible to improvement. For example, the present inventor has determined that the manner by which the batteries are accessed for removal and replacement is susceptible to improvement. The present inventor has also determined that that it would be desirable to secure the battery holder to the hearing assistance device housing in a manner that will reduce the likelihood that an infant or toddler could remove the battery holder, as well as reduce the likelihood that the battery holder will be inadvertently opened, without making it substantially more difficult for adults to remove. The present inventor has also determined that that it would be desirable to provide the user with greater flexibility with respect to the level of effort that will be required to remove the battery holder.

SUMMARY

A power supply system, for use with a hearing assistance device, having a housing including a battery storage region, a first removable battery holder including a first latch having a first latch configuration, and a second removable battery holder including a second latch having a second latch configuration that is different that the latch configuration. The present inventions also include hearing assistance device kits that include a hearing assistance device (e.g., a sound processor or a hearing aid) in combination with such a system.

A power supply system, for use with a hearing assistance device, having a housing including a main housing portion with an internal battery storage region, a removable housing portion and a latch member, the main housing portion and the removable housing portion together defining a housing outer surface, the housing outer surface including an opening, a battery holder, on which the removable housing portion is carried, that is configured to fit within the battery storage region, to hold at least one battery and to move linearly in and out of the internal battery storage region, such that the removable housing portion is aligned with the main housing portion when the battery holder is in a fully inserted position within the battery storage region, and a battery holder latch associated with the removable battery holder and the housing and including a latch member and a button with an end surface, at least a portion of the battery holder latch being movable between an extended position, where the battery holder latch member engages the housing latch member to prevent movement of the battery holder and the button end surface is located at or inward of the opening in the outer surface, and a retracted position, where the battery holder latch member is disengaged from the housing latch member to permit movement of the battery holder. The present inventions also include hearing assistance devices (e.g., a cochlear implant sound processor or a hearing aid) with such a system.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF THE EXEMPLARY EMBODIMENTS

The following is a detailed description of the best presently known modes of carrying out the inventions. This description is not to be taken in a limiting sense, but is made merely for the purpose of illustrating the general principles of the inventions.

The present inventions have application in a wide variety of hearing assistance devices that provide sound (i.e., either sound or a perception of sound) to the hearing impaired as well as others who require such hearing devices on a situational basis. Examples of such hearing assistance devices include ICS systems, where an external sound processor communicates with a cochlear implant, and hearing aids. The present inventions are not, however, limited to ICS systems and hearing aides, and may be employed in combination with other hearing assistance devices that currently exist, or are yet to be developed.

Figure 1:
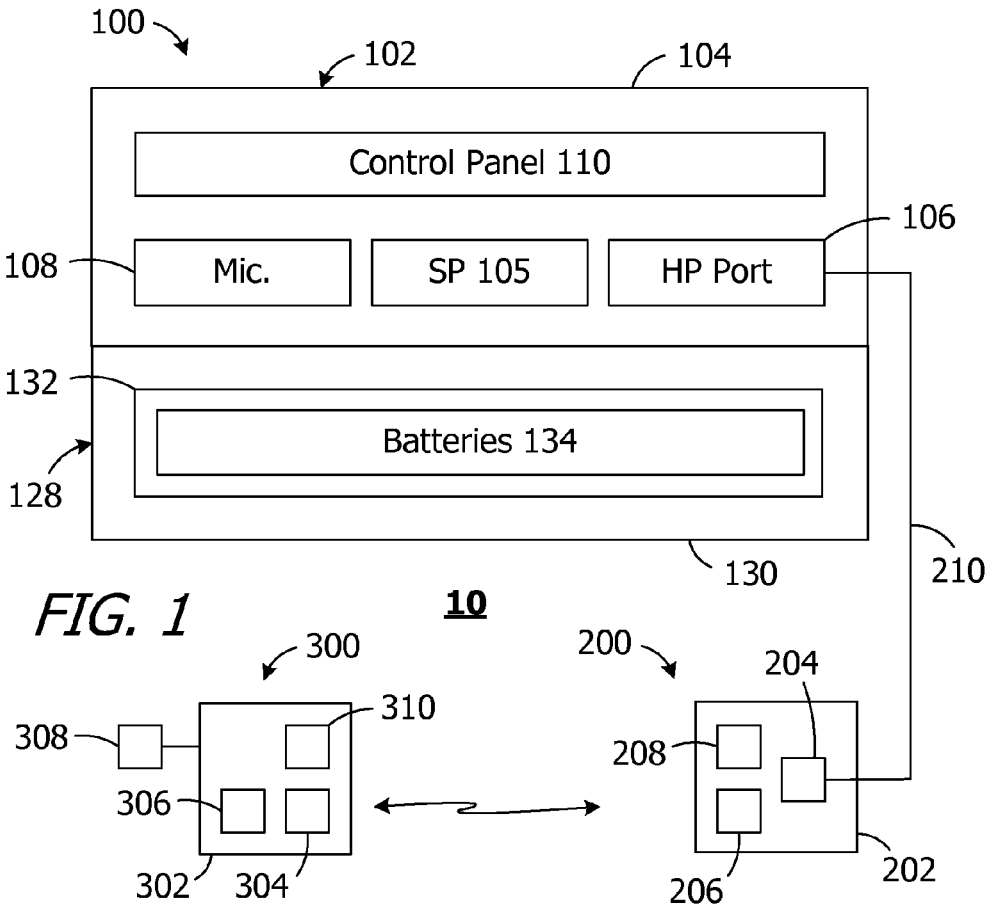
FIG. 1 is a functional block diagram of an ICS system in accordance with one embodiment of a present invention.

One example of a hearing assistance device is the ICS system generally represented by reference numeral 10 in FIG. 1. The exemplary ICS system 10 includes a BTE unit 100, a headpiece 200, and a cochlear implant 300.

Figure 2:
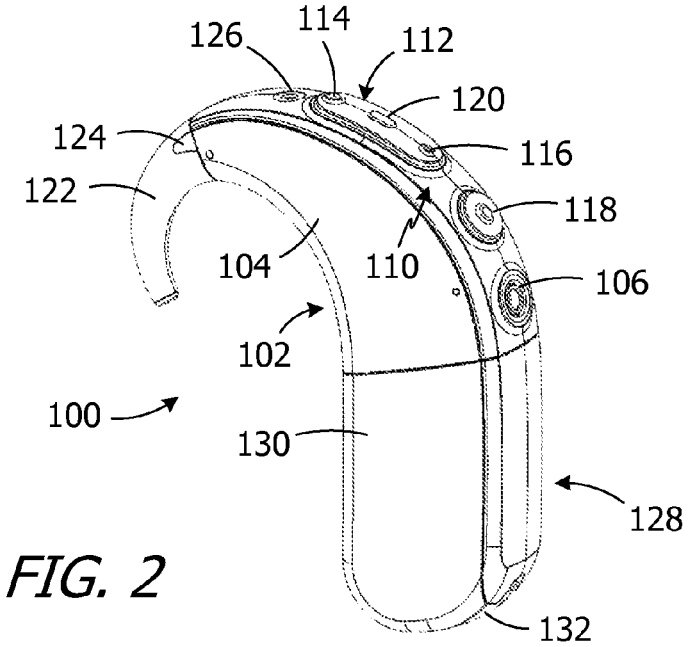
FIG. 2 is a perspective view of a BTE unit in accordance with one embodiment of a present invention.

Referring first to FIGS. 1 and 2, the exemplary BTE unit 100 includes a sound processor 102 with a processor housing 104 in which and/or on which various components are supported. Such components may include, but are not limited to, sound processor circuitry 105, a headpiece port 106, a microphone 108, and a control panel 110. The exemplary control panel 110 has a rocker-type volume switch 112, with tactile markers 114 and 116 that correspond to volume up and volume down movement of the switch, a program selector switch 118, and an indicator light (e.g., an LED) 120. An ear hook 122 with an indentation 124 may be secured to the housing 102. A sound port 126 for the microphone 108 extends through the housing 104 adjacent to the volume switch 112, and another sound port (not shown) extends through the housing adjacent to the earhook indentation 124. The BTE unit 100 also includes a power supply 128 that supplies power to the sound processor circuitry 105 and other power consuming components of the sound processor 102. As discussed in greater detail below, the power supply 128 includes a power supply housing 130 and a battery holder 132 for removable batteries or other removable power supplies 134 (e.g., rechargeable and disposable batteries or other electrochemical cells). The battery holder 132 may be completely removable from the remainder of the power supply 128 in some instances, and partially removable to a point at which the batteries can be removed and replaced in other instances.

The exemplary headpiece 200 includes a housing 202, as well as various components, e.g., a RF connector 204, a transmitter (e.g., an antenna) 206 and a positioning magnet 208, that are carried by the housing. The headpiece 200 in the exemplary ICS system 10 may be connected to the sound processor headpiece port 106 by a cable 210. It should be noted that, in other implementations, communication between a sound processor and a headpiece may be accomplished through wireless communication techniques.

The exemplary cochlear implant 300 includes a housing 302, a receiver (e.g., an antenna) 304, an internal processor 306, a cochlear lead 308 with an electrode array, and a positioning magnet (or magnetic material) 310. The transmitter 206 and receiver 304 communicate by way of electromagnetic induction, radio frequencies, or any other wireless communication technology. The positioning magnet 208 and positioning magnet (or magnetic material) 310 maintain the position of the headpiece transmitter 206 over the cochlear implant receiver 304.

During use, the microphone 108 picks up sound from the environment and converts it into electrical impulses, and the sound processor 105 filters and manipulates the electrical impulses and sends the processed electrical signals through the cable 210 to the transmitter 206. Electrical impulses received from an auxiliary device are processed in essentially the same way. The receiver 304 receives signals from the transmitter 206 and sends the signals to the cochlear implant internal processor 306, which modifies the signals and passes them through the cochlear lead 308 to the electrode array. The electrode array may be wound through the cochlea and provides direct electrical stimulation to the auditory nerves inside the cochlea. This provides the user with sensory input that is a representation of external sound waves which were sensed by the microphone 108.

Figure 3:
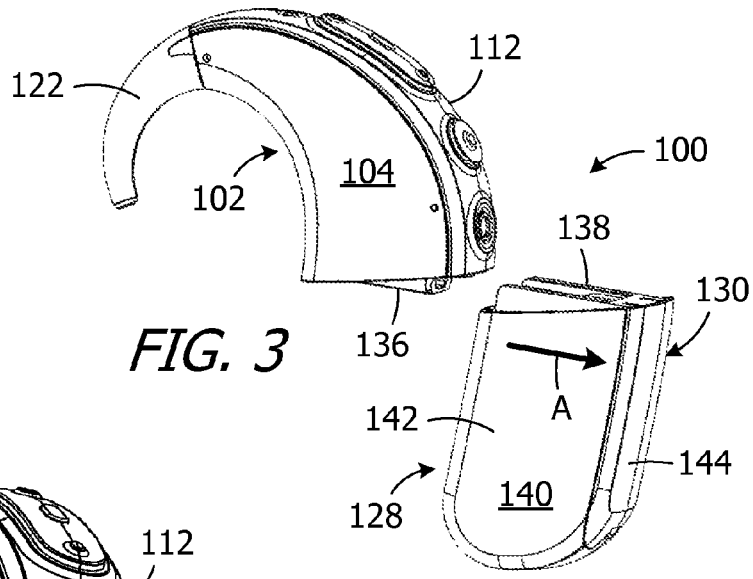
FIG. 3 is an exploded view of the BTE unit illustrated in FIG. 2.
Figure 4:
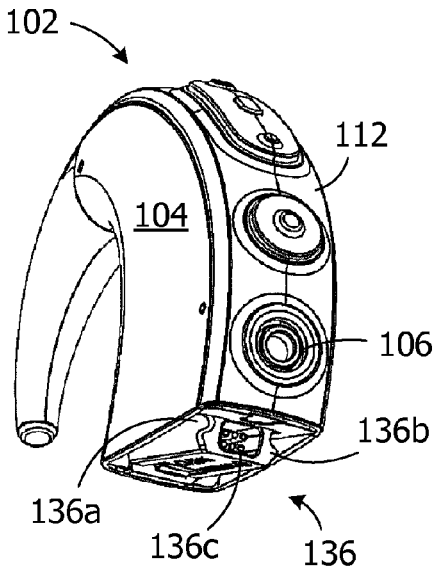
FIG. 4 is a perspective view of the sound processor of the BTE unit illustrated in FIG. 2.
Figure 5:
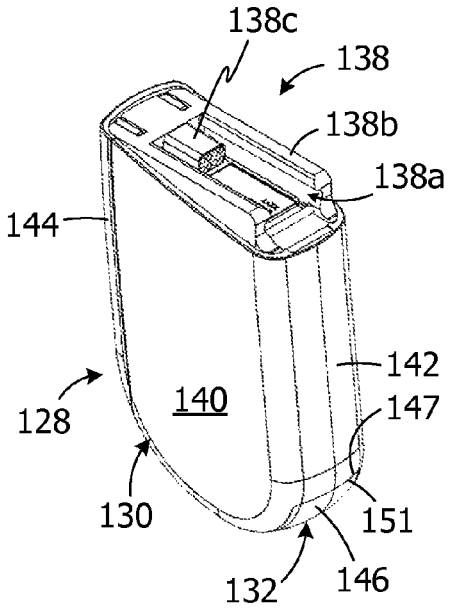
FIG. 5 is a perspective view of the power supply of the BTE unit illustrated in FIG. 2.

Turning to FIGS. 3-5, the power supply 128 in the illustrated implementation is a removable device that may be mechanically and electrically disconnected from, and re-connected to, the sound processor 102. To that end, the sound processor 102 includes a connector 136 with slots 136*a*, protrusions 136*b* and electrical conductors 136*c*, while the power supply 128 includes a corresponding connector 138 with slots 138*a*, protrusions 138*b* and a receptacle 138*c* for the electrical conductors 136*c*. The power supply 128 may be disconnected from the sound processor 102 by moving the power supply in the direction of arrow A and re-connected by moving the power supply 128 in the opposite direction. In other implementations, the sound processor 102 and the power supply 128 may be permanently connected to one another (i.e., formed as a single, integral unit), although the battery holder 132 would be configured, and would operate, in the manner described above and below.

Figure 6:
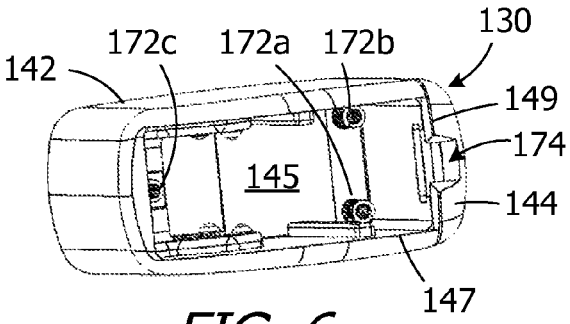
FIG. 6 is a bottom perspective view of the power supply illustrated in FIG. 5 with the battery holder removed.
Figure 7:
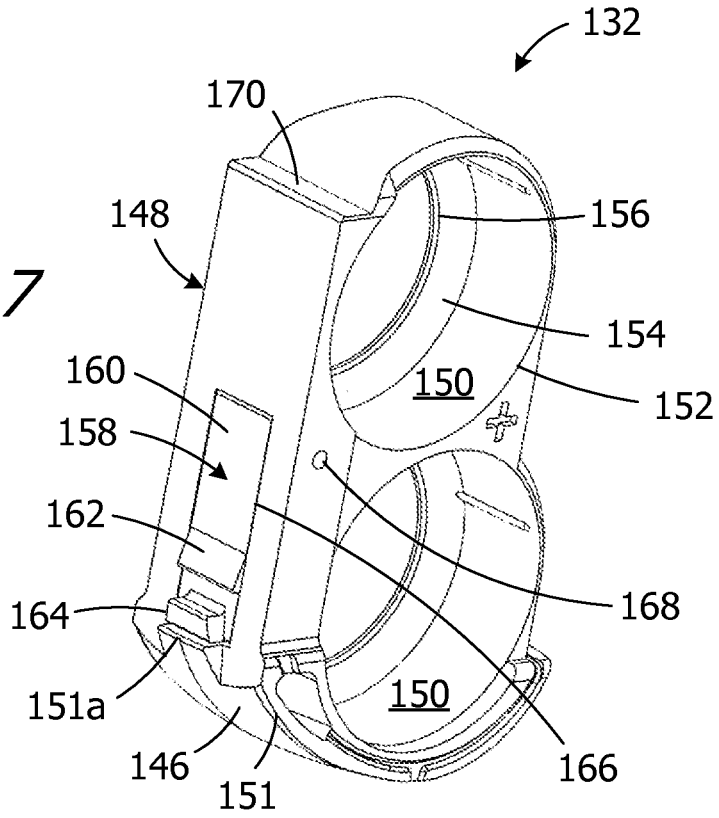
FIG. 7 is a perspective view of the battery holder of the power supply illustrated in FIG. 5.
Figure 12:
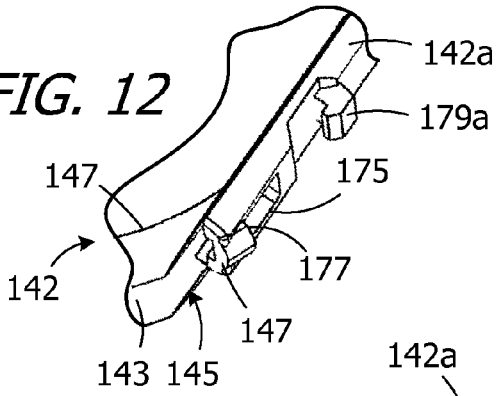
FIG. 12 is an enlarged perspective view of a portion of the power supply illustrated in FIG. 5 with the housing cap and battery holder removed.

As can also be seen in FIGS. 3 and 5, the exemplary power supply housing 130 includes a main housing portion 140, and the exemplary main housing portion includes a fixed enclosure 142 and a replaceable cap 144. The cap 144 is an aesthetic element that, for example, may be provided in various colors so that the color of a portion of the housing 130 may be changed through replacement of the cap. The cap 144 may be omitted in other implementations. The housing 130 also includes a removable housing portion 146 that is carried by the battery holder 132 (FIGS. 7-10). The main housing portion 140 defines an internal battery storage volume (or "region") 143 (FIG. 12). The removable housing portion 146 is associated with the bottom (in the use orientation) of the housing 130. To that end, the bottom of the main housing portion 140 has an opening 145 (FIG. 6) that is defined by inner perimeter edge 147 of the enclosure 142, a portion of which is covered by the edge 149 of the cap 144. The removable housing portion 146 has an outer perimeter edge 151 (FIGS. 5 and 7). When the battery holder 132 is in the fully inserted position within the main housing portion 140, the outer perimeter edge 151 of the removable housing portion 146 abuts and is aligned with the inner perimeter edge 147 and the cover edge 149 of the main housing portion 140, which results in the housing having a smooth, continuous exterior surface.

Referring to FIG. 7, the exemplary battery holder 132 includes main body 148 with a pair of battery storage spaces 150. Each battery storage space 150 has an inlet aperture 152 that is sized to accept the associated battery (e.g., a zinc-air battery), an end wall 154, and an end wall aperture 156 that is small enough to prevent passage of the battery therethrough. The apertures 152 and 156 also provide battery access for the electrical contacts 187 and 188 described below with reference to FIG. 18. Although the exemplary battery holder 132 is configured to hold two batteries, other battery holders in accordance with the present inventions may be configured to hold one battery or three or more batteries. A latch 158 with a main portion 160, a latch member 162 and a button 164 is also provided. The latch 158, which engages a portion of the power supply housing 130 to maintain the battery holder 132 in the fully inserted position, is described in greater detail below with reference to FIGS. 11-15. The latch 158 is located within an opening 166 in the battery holder main body 148 and is mounted, for example, on a pin 168. Inward movement of the latch 158, or a portion thereof, caused by pressing of the button 164 disengages the latch member 162 from the main housing portion 140 so that the battery holder 132 can be removed therefrom.

The exemplary battery holder 132 illustrated in FIG. 7 also has a surface 170 that abuts springs 172*a* and 172*b* (FIG. 6), and another surface (not shown) that abuts spring 172*c* (FIG. 6), when the battery holder is within the main housing portion 140. The springs 172*a*-172*c* are compressed when the battery holder 132 is in the fully inserted position (FIGS. 3 and 5) and, accordingly, the springs bias the battery holder away from the fully inserted position (note FIG. 18). The lengths of the springs 172*a*-172*c* in the illustrated implementation is such that they will push the battery holder 132 a short distance, i.e., about 0.1 inch (about 2.5 mm), out of the fully inserted position, to a partially removed position, when the latch 158 is disengaged. The user may then pull the battery holder 132 completely out of the housing 130.

Figure 8:
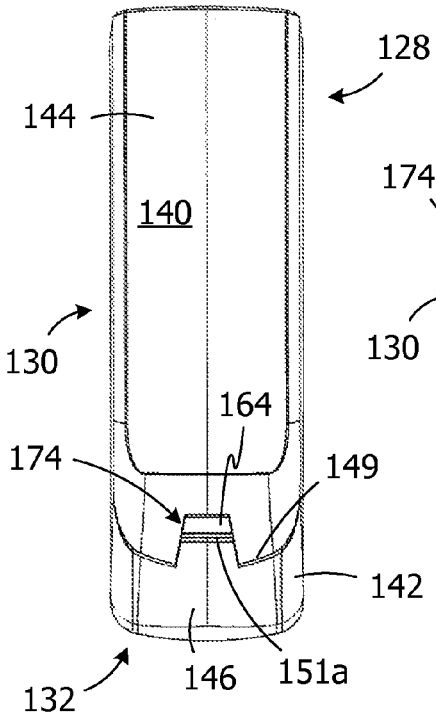
FIG. 8 is a side view of the power supply illustrated in FIG. 5.
Figure 9:
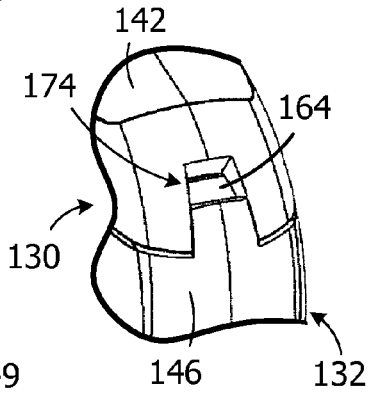
FIG. 9 is an enlarged perspective view of a portion of the power supply illustrated in FIG. 5.
Figure 10:
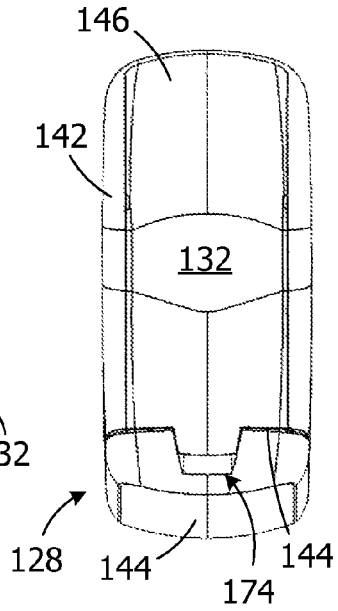
FIG. 10 is a bottom view of the power supply illustrated in FIG. 5.

Turning to FIGS. 8-10, the exemplary power supply housing 130 has a latch button opening 174 that extends inwardly from the outer surface of housing. The latch member button 164 is located within the opening 174 and is also located at or below outer surface of the housing 130. In other words, no portion of the latch button 164 extends outwardly beyond the outer surface of the housing 130. This configuration prevents inadvertent pressing of the latch member button 164 and, therefore, prevents inadvertent release of the latch 158 and removal of the battery holder 132 from the power supply housing 130 when a finger or object slides along the housing surface. The opening 174 is also very small, e.g., about 2 mm by 1 mm, which prevents structures larger than pin or a tip of a ball point pen from pushing the latch member button 164. The size of the opening 174 and the location of the latch member button 164 below the outer surface of the housing 130 also make it essentially impossible for an infant or toddler to remove the battery holder 132 and gain access to the batteries. However, the button can be easily pressed, without the use of a special tool, with the aforementioned pen tip or other suitably sized device.

Figure 11:
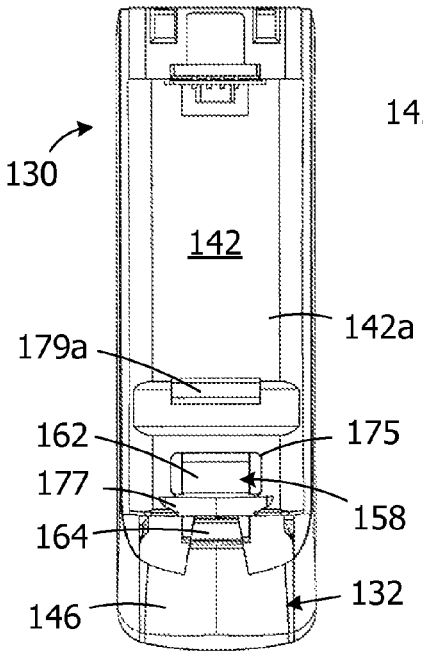
FIG. 11 is a side view of the power supply illustrated in FIG. 5 with the housing cap removed.
Figure 13:
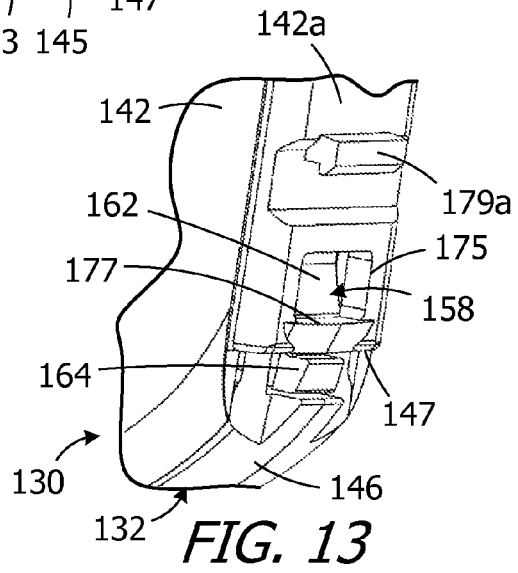
FIG. 13 is an enlarged perspective view of a portion of the power supply illustrated in FIG. 5 with the housing cap removed.
Figure 16:
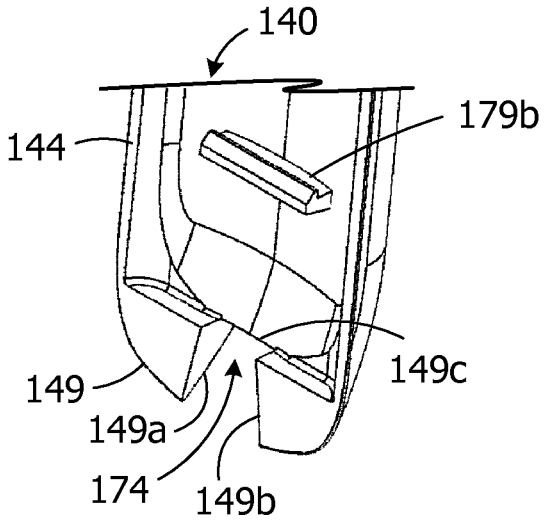
FIG. 16 is a partial perspective view of a portion of the interior side of the housing cap of the power supply illustrated in FIG. 5.

As shown by way of example in FIGS. 11-13, which show the housing 130 with the cap 144 removed, the enclosure 142 is defined by a plurality of walls and wall 142*a* is located under cap 144. The enclosure wall 142*a* includes a latch member opening 175 in which the latch member 162 is located when the latch 158 is in the engaged state. The enclosure wall 142*a* also includes a projection 177 (or "latch member"), with a top surface (in the illustrated orientation) that is engaged by the latch member 162 to prevent removal of the battery holder 132, and a connector 179*a* that engages a corresponding connector 179*b* (FIG. 16) on the cap 144. The bottom surface of the projection forms part of the inner perimeter edge 147 (note FIG. 12).

Figure 14:
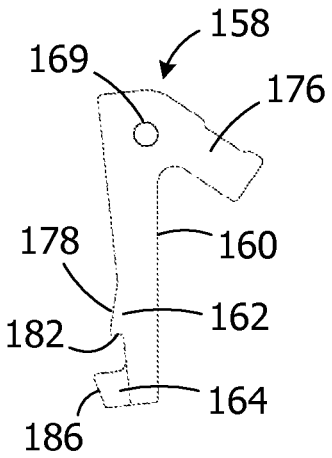
FIG. 14 is a side view of the latch of the battery holder illustrated in FIG. 7.
Figure 15:
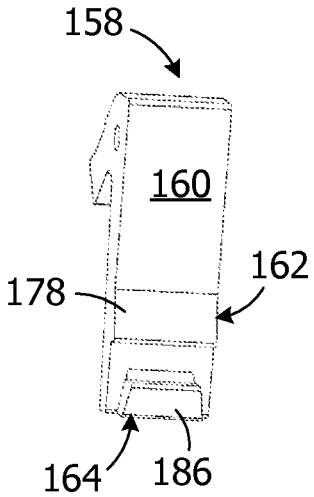
FIG. 15 is a perspective view of the latch illustrated in FIG. 14.

As illustrated for example in FIGS. 14 and 15, the latch 158 includes a pin aperture 169 for the pin 168 (FIG. 7) and a lever 176 that engages a structure (not shown) within the battery holder main body 148 to prevent rotation of the latch 158 about the pin 168. The resiliency of the latch 158 provides a biasing force that biases the latch to the latched state. The resiliency of the latch material (e.g., plastic) will allow portions of the latch 158 to bend so that the main body 160 can move inwardly when the button 164 is pressed. The main body 160 also moves inwardly when the battery holder 132 is being inserted into the housing 130, i.e., just prior to the battery holder reaching the fully inserted position, and then returns to the outwardly biased state with the latch member 162 within the latch member opening 175 due to the resilience. To that end, the latch member 162 has a cam surface 178 that engages the bottom of the projection 177, thereby causing the latch 158 to bend inwardly as the battery holder 132 approaches the fully inserted position. The latch member 162 can then slide along the inner surface of the projection 177 until it reaches the latch member opening 175. The latch member surface 182 will abut the top surface of the projection 177 (or "latch member"), thereby preventing removal of the battery holder 132, when the battery holder reaches the fully inserted position.

In other implementations, the latch 158 may pivot about the pin 168. Here, a biasing element may be positioned within the main body 148 such that it exerts a biasing force on the lever 176, thereby biasing the latch 158 to the latched position.

The exemplary opening 174 is defined by three edges (or walls) 149*a*-149*c* (FIG. 16) on the main housing portion 140 and edge (or wall) 151*a* (FIG. 8) on the removable housing portion 146. The edges 149*a*-149*c* are portions of the perimeter edge 149 of the cap 144, while the edge 151*a* is a portion of the edge 151 of the battery holder 132. The respective sizes of the latch button 164 and the opening 174 are such that the button occupies all or at least substantially all of the cross-sectional area of the opening (viewed perpendicular to the perimeter of the opening). As such, the user will surely engage the button 164 when the user successfully inserts a pen or other device into the opening 174. The button end 186, i.e. the end that is engaged by the user, is slanted.

Figure 17:
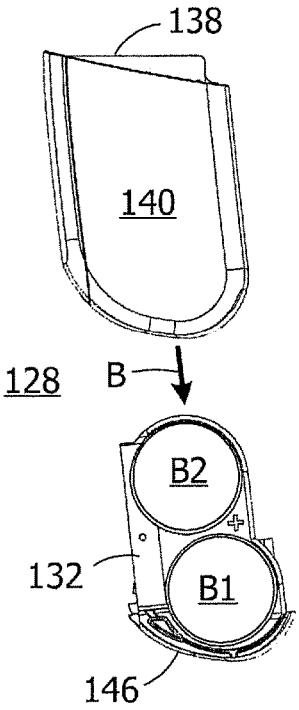
FIG. 17 is an exploded view showing the removal of the battery holder from the power supply illustrated in FIG. 5.

It should also be noted that the exemplary battery holder 132 moves in a linear direction, i.e., along an axis, as it is removed from the power supply main housing portion 140 that is identified by arrow B in FIG. 17. The batteries B1 and B2 may be removed and replaced, and the battery holder 132 may then be reinserted into the power supply main housing portion 140 by moving it linearly in the opposite direction.

Figure 18:
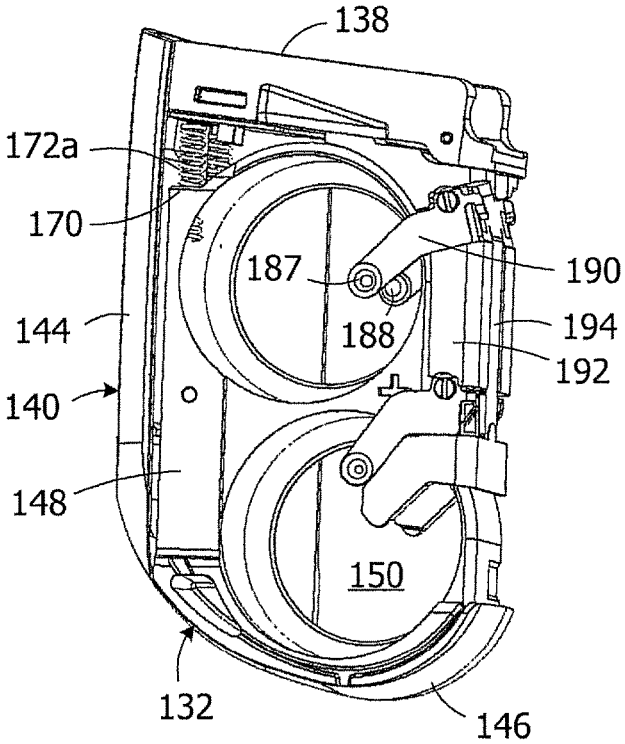
FIG. 18 is a perspective view of the power supply illustrated in FIG. 5 with portions of the housing removed.

With respect to the manner in which the batteries B1 and B2 are electrically connected to the power supply 128, and referring to FIG. 18, the power supply includes two sets of positive and negative contacts 187 and 188 that are mounted on resilient arms 190. The arms 190 are mounted on an internal support 192 that is secured to and within the main housing portion 140. A ribbon connector 194 electrically connects the contacts 187 and 188 to the connector 138.

Figure 19:
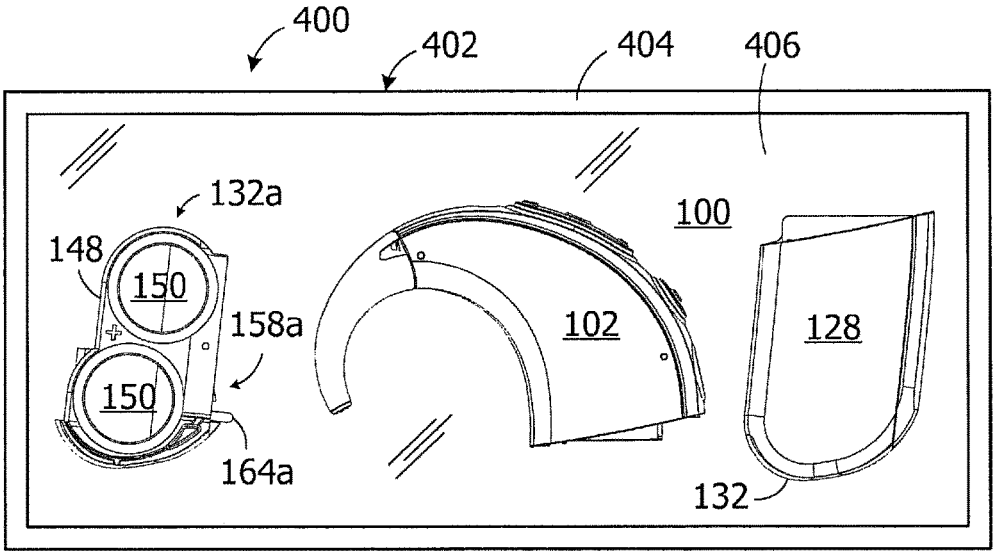
FIG. 19 is a plan view of a hearing assistance device kit in accordance with one embodiment of a present invention.
Figure 20:
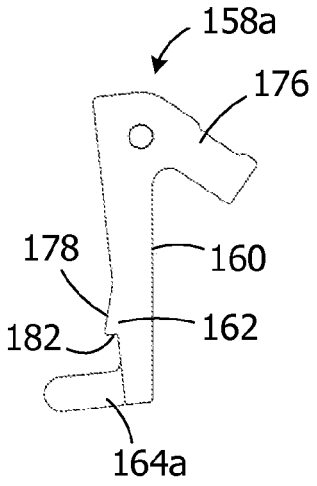
FIG. 20 is a side view of the battery holder latch in accordance with one embodiment of a present invention.
Figure 21:
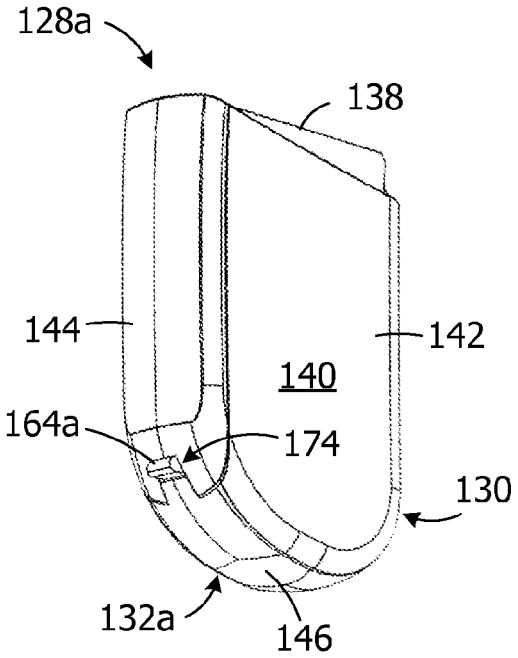
FIG. 21 is a perspective view of a power supply with a battery holder that includes the latch illustrated in FIG. 20.

A hearing assistance device kit in accordance with one embodiment of a present invention is generally represented by reference numeral 400 in FIG. 19. The kit 400 includes a BTE unit 100, which is identical to the BTE unit described above with reference to FIGS. 1-18, that has a sound processor 102 and a power supply 128 with a battery holder 132. The kit 400 also includes a second battery holder 132*a* that may be inserted into the power supply housing 130 in place of the battery holder 132 to define a power supply 128*a* (FIG. 21). The BTE unit 100 and second battery holder 132*a* may be stored in packaging 402, which in the illustrated implementation includes a box or other enclosure 404 with a cover 406. The cover may be transparent as shown. The second battery holder 132*a* is identical to the battery holder 132, but for the configuration of their respective latches 158*a* and 158, and similar elements are represented by similar reference numerals. The battery holder 132*a* includes latch 158*a* that can be disengaged from the housing 130, to facilitate removal of the battery holder, without inserting a pen tip or other object into the opening 174. To that end, and referring to FIGS. 20 and 21, the latch 158*a* includes a latch button 164*a* that is substantially longer than the latch button 164. When the battery holder 132*a* is in the fully inserted position within the power supply housing 130, the latch button 164*a* will extend through the opening 174 and outwardly beyond the outer surface of the power supply housing 130. As such, the button 164*a* may be readily depressed by pressing it with a finger to release the latch 158*a*.

The exemplary kit 400 provides the user with the ability to conveniently select a battery holder that is most appropriate for his/her needs and to switch from battery holder to the other as circumstances so require. For example, the battery holder 132 may be more appropriate for an infant or toddler and the battery holder 132*a* could be employed when the child is older. Alternatively, in the context of adults, the battery holder 132*a* may be preferred except in those instances where the battery holder could be inadvertently opened due to contact.

Figure 22:
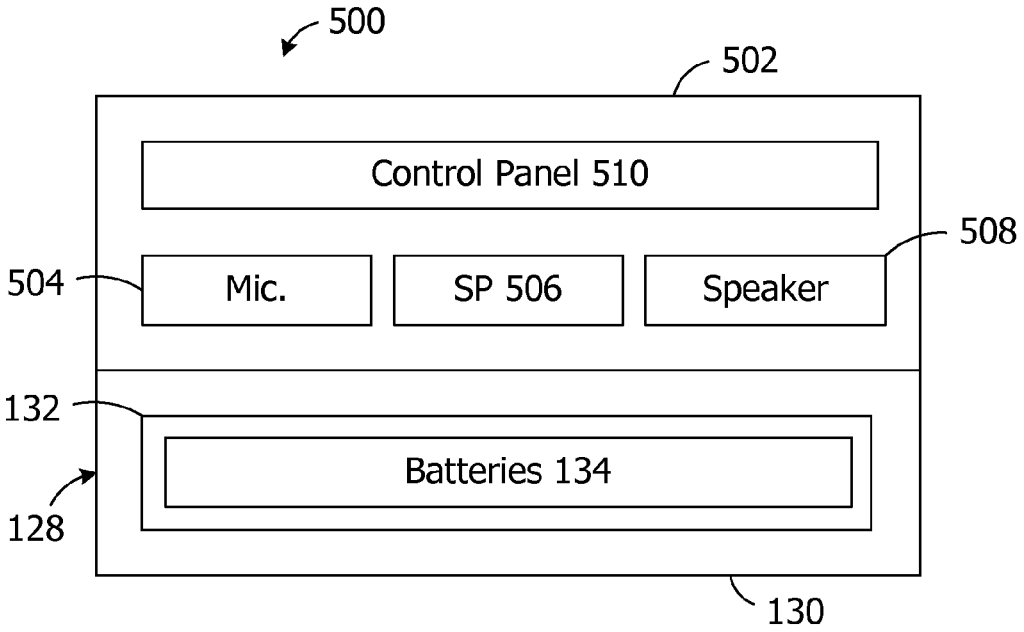
FIG. 22 is a functional block diagram of a hearing aid in accordance with one embodiment of a present invention.

Another example of a hearing assistance device is the BTE hearing aid generally represented by reference numeral 500 in FIG. 22. The exemplary BTE hearing aid 500 includes a housing 502, a microphone 504, sound processor circuitry 506, a speaker 508 and a control panel 510 with components such as an ON/OFF switch and a volume control. The BTE hearing aid 500, which has an overall physical configuration (i.e., shape and size) that is similar to the BTE unit 100, also includes the power supply 128, as described above, that supplies power to the sound processor circuitry 506 and other power consuming components. Here too, a power supply 128 includes a power supply housing 130 and a battery holder 132 for removable batteries or other removable power supplies 134. The battery holder 132 may be completely removable from the remainder of the power supply 128 in some instances, and partially removable in others. The BTE hearing aid 500 may also be provided in a kit with a second battery holder in a manner similar to that described above with reference to FIGS. 19-21.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

I claim:

1. A power supply system for use with a hearing assistance device, the power supply system comprising:

a housing including a battery storage region, an outer surface and an opening;

a first removable battery holder including a first latch, with a first button having a first length, configured to hold at least one battery and to fit within the battery storage region in such a manner that the first button will be located within the opening and will not extend outwardly beyond the outer surface when the first removable battery holder is in a fully inserted position within the battery storage region; and a second removable battery holder including a second latch, with a second button having a second length that is greater than the first length, configured to hold at least one battery and to fit within the battery storage region in such a manner that the second button will be located within the opening and extend outwardly beyond the outer surface when the second removable battery holder is in a fully inserted position within the battery storage region;

wherein the respective configurations of the battery storage region, the first removable battery holder and the second removable battery holder are such that only one of the first and second removable battery holders can be located within the battery storage region at a time.

2. A power supply system as claimed in claim 1, wherein the housing includes electrical and mechanical connectors that are configured to mechanically and electrically mate with corresponding electrical and mechanical connectors on the hearing assistance device.

3. A power supply system as claimed in claim 1, wherein the housing includes a latch surface;

the first latch includes a first projection that is configured to engage the latch surface;

the second latch includes a second projection that is configured to engage the latch surface.

4. A power supply system as claimed in claim 1, wherein the first removable battery holder is configured to hold two batteries; and the second removable battery holder is configured to hold two batteries.

5. A power supply system as claimed in claim 1, further comprising:

at least one biasing member that applies a force to a battery holder within the battery storage region to urge the battery holder away from the fully inserted position within the battery storage region.

6. A power supply system as claimed in claim 5, wherein the at least one biasing member is configured to move the battery holder a short distance from the fully inserted position.

7. A hearing assistance device, comprising:

a sound processor; and a power supply system as claimed in claim 1.

8. A hearing assistance device as claimed in claim 7, wherein the sound processor comprises a cochlear implant sound processor.

9. A hearing assistance device as claimed in claim 7, wherein the sound processor comprises a hearing aid sound processor.

10. A power supply system as claimed in claim 1, wherein the first button includes an end surface that is slanted relative to the housing outer surface.

11. A power supply system as claimed in claim 1, wherein the opening defines a perimeter, the housing defines three sides of the perimeter and the first and second battery holders define a fourth side of the perimeter when the first and second battery holders are located within the battery storage region.

12. A power supply system as claimed in claim 11, wherein the opening is about 2 mm×1 mm.

13. A power supply system as claimed in claim 1, wherein the first latch is biased to an extended position; and the second latch is biased to an extended position.

* * * * *